US006837557B2

(12) United States Patent
Domenig

(10) Patent No.: US 6,837,557 B2
(45) Date of Patent: Jan. 4, 2005

(54) DRAWER SUPPORT AND CLOSURE APPARATUS

(76) Inventor: Georg Domenig, 1110 Whispering Pines, Kernersville, NC (US) 27284

( * ) Notice: Subject to any disclaimer, the term of this patent is extended or adjusted under 35 U.S.C. 154(b) by 0 days.

(21) Appl. No.: 10/440,216

(22) Filed: May 19, 2003

(65) Prior Publication Data

US 2003/0193279 A1 Oct. 16, 2003

Related U.S. Application Data

(63) Continuation of application No. 10/042,821, filed on Jan. 11, 2002.

(51) Int. Cl.[7] ..... A47B 88/04

(52) U.S. Cl. ..... 312/334.34; 312/334.31; 312/334.27; 312/334.4; 312/334.5

(58) Field of Search ..... 312/334.5, 333, 312/334.27, 334.28, 334.29, 334.31, 334.32, 334.34, 334.35, 330.1, 334.1, 334.4, 334.6, 334.36, 334.39, 334.41; 384/22

(56) References Cited

U.S. PATENT DOCUMENTS 2,587,691 A * 3/1952 Brewer ..... 312/334.41
3,375,051 A * 3/1968 Anderson ..... 384/19
3,825,310 A * 7/1974 Roemer ..... 384/23
4,244,546 A * 1/1981 Mertes et al. ..... 248/258
4,278,309 A * 7/1981 Dreiling ..... 384/22
4,305,625 A * 12/1981 Gutner et al. ..... 384/19
4,441,773 A * 4/1984 Leiper ..... 312/330.1
4,752,143 A * 6/1988 Lautenschlager, Jr. ..... 384/19
5,588,729 A * 12/1996 Berger ..... 312/334.4
5,709,443 A * 1/1998 Lautenschlager ..... 312/334.14
5,876,103 A * 3/1999 Domenig ..... 312/334.4

FOREIGN PATENT DOCUMENTS

CA 702106 * 1/1965
DE 3822575 * 1/1989 ..... A47B/88/04

* cited by examiner

*Primary Examiner*—James O. Hansen

(57) ABSTRACT

A drawer slide support and closure apparatus designed to support a drawer within its supporting frame includes one or more drawer support members connecting the frame front and back each of which has an upstanding member with a ridge formed therewith forming a guide rail. A ridge surrounding slidable member encompasses the guide rail and is movable with respect to it. The ridge surrounding member is affixed to the bottom of the drawer and enables slidable movement between the guide rail supported by the frame and the ridge surrounding member affixed to the drawer. Rollers provide additional support for the drawer in the open position, and a spring enables positive opening and closing of the drawer. A shock absorber minimizes sound and impact when the drawer is firmly closed.

12 Claims, 13 Drawing Sheets

DRAWER SUPPORT AND CLOSURE APPARATUS

This application is a continuation application of my application Ser. No. 10/042,821 filed Jan. 11, 2002.

BACKGROUND OF THE INVENTION

1. Field of the Invention

The present invention relates to drawer supporting and closing mechanisms and more particularly for a drawer slide support and closure apparatus that enables one or more drawer support members to facilitate slidably openable and closeable drawers within a frame.

2. Description of the Prior Art

Slidable drawer opening and closing devices are well known and conventionally utilize a pair of supporting and slidably connected guide rails and rail engaging slides to support the drawer within its frame and allow for openable and closeable slidable movement therein. Apparatus of the type used in conventional drawer slides is expensive in that these devices are usually formed of metal, attached to the inner side of the frame by a large profile limb and, require two units in each drawer setting.

Many attempts have been made to reduce the cost of these devices by reducing the amount of metal incorporated in each, replacing certain elements with plastic materials where feasible, or simplifying the design of each slide where such simplification is possible.

Despite the attempts to improve and simplify such dual drawer slides, there is still a need to additionally reduce the cost of this hardware and yet provide an efficient and reliable device to accomplish the slideable drawer function. It is to this need for cost reduction, simplicity and durability that the present invention is directed.

SUMMARY AND OBJECTIVES OF THE INVENTION

The present invention includes a drawer slide support apparatus for slideably maintaining a drawer within a supporting frame. The apparatus has, in one embodiment, a single longitudinal drawer support member connecting the supporting frame front and back having an upstanding segment with a ridge associated therewith, the upstanding segment and ridge forming a guide rail. A ridge-surrounding member affixed to the bottom of the carried drawer cooperatively receives the ridge in close proximity to the upstanding segment and moves with respect to the ridge. A movement facilitating and supporting device is positioned between the ridge and the ridge-surrounding member and enables a smooth, quiet and stable movable relationship between the drawer supported by the apparatus and the frame within which the drawer is positioned. Additional support and stability for the drawer is provided by positioning rollers on the front of the drawer frame member to engage preselected locations along the drawer width and maintain it at a level condition throughout movement. Another supporting member can include a small load-bearing roller affixed to the upstanding member to support the ridge surrounding member.

One or more devices of the invention may be used with a drawer, the number depending upon the size and weight to be carried by the drawer. The guide rail fastens to the front and back of the frame and not to the frame side as is usually the case and therefore can be positioned at any desired or needed location within the width of the drawer.

The guide rail and its associated upstanding member and ridge is of about the same length as the ridge-surrounding member so that the drawer can be substantially displaced from the frame in its openable condition. A spring mechanism is utilized to be active during the opening and closing of the drawer and principally to urge the drawer into the drawer supporting frame during drawer closure to firmly seat and hold the drawer within the frame. A shock absorber engages the frame when the spring closes the drawer to minimize sound and impact when the drawer is firmly seated by the spring mechanism. A ridge-surrounding member supporting roller may be positioned in a non-viewable location on the front of the frame to provide further stability and support for the drawer and its associated mechanism when it is in the open position.

With this brief summary concerning the invention in mind, it is therefore apparent that a primary object of the present invention is to provide a drawer support member to support the drawer and its opening and closing functions.

Another objective of the present invention is to provide an apparatus of the type described that is reliable in operation and functions smoothly in a manner similar to that usually requiring a plurality of more expensive and complicated drawer slides.

Yet another objective of the present invention is to provide an apparatus of the type described that can be suitably adjusted to provide for maximum drawer opening and closing efficiency.

A further objective of the present invention is to provide an apparatus of the type described that is significantly less costly yet equally reliable when compared to conventional drawer closure devices.

Thus there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In that respect, before explaining at least on embodiment of the invention in detail, it is to be understood that the invention is not limited in its arrangement of the components set forth in the following description and illustrated in the drawings. The invention is capable of other embodiments and of being practiced and carried out in various ways.

It is also to be understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development. It is important that the claims be regarded as including such equivalent methods and products resulting therefrom that do not depart from the spirit and scope of the present invention. The application is neither intended to define the invention of the application, which is measured by its claims, nor to limit its scope in any way.

Thus, the objects of the invention set forth above, along with the various features of novelty which characterize the invention, are noted with particularity in the claims annexed to and forming a part of this disclosure. For a better understanding of the invention, its operating advantages and the specific results obtained by its use, reference should be made to the following detailed specification taken in conjunction with the accompanying drawings wherein like characters of reference designate like parts throughout the several views.

DETAILED DESCRIPTION OF THE PREFERRED EMBODIMENT

Figure 1:
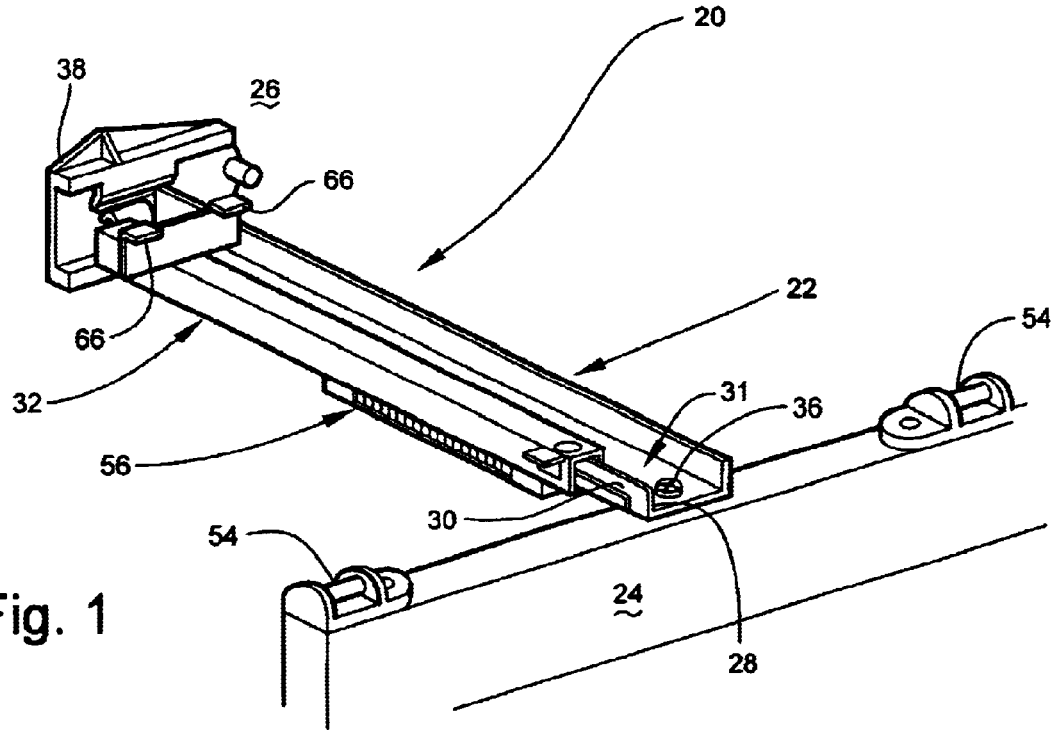
FIG. 1 is a perspective and fragmentary view of the apparatus comprising a single unit of the present invention which is connecting the supporting frame front and back.

Referring now to the drawings and particularly to FIG. 1, the drawer support and closure apparatus of the present invention is shown generally as 20 and includes a drawer support member 22 connecting the supporting frame front 24 and back 26. Support member 22 has an upstanding segment 28 and a ridge 30 formed therewith also referred to as a guide rail and shown generally as 31. All of these components are formed integrally with support member 22 preferably in a metal stamping operation.

Figure 3:
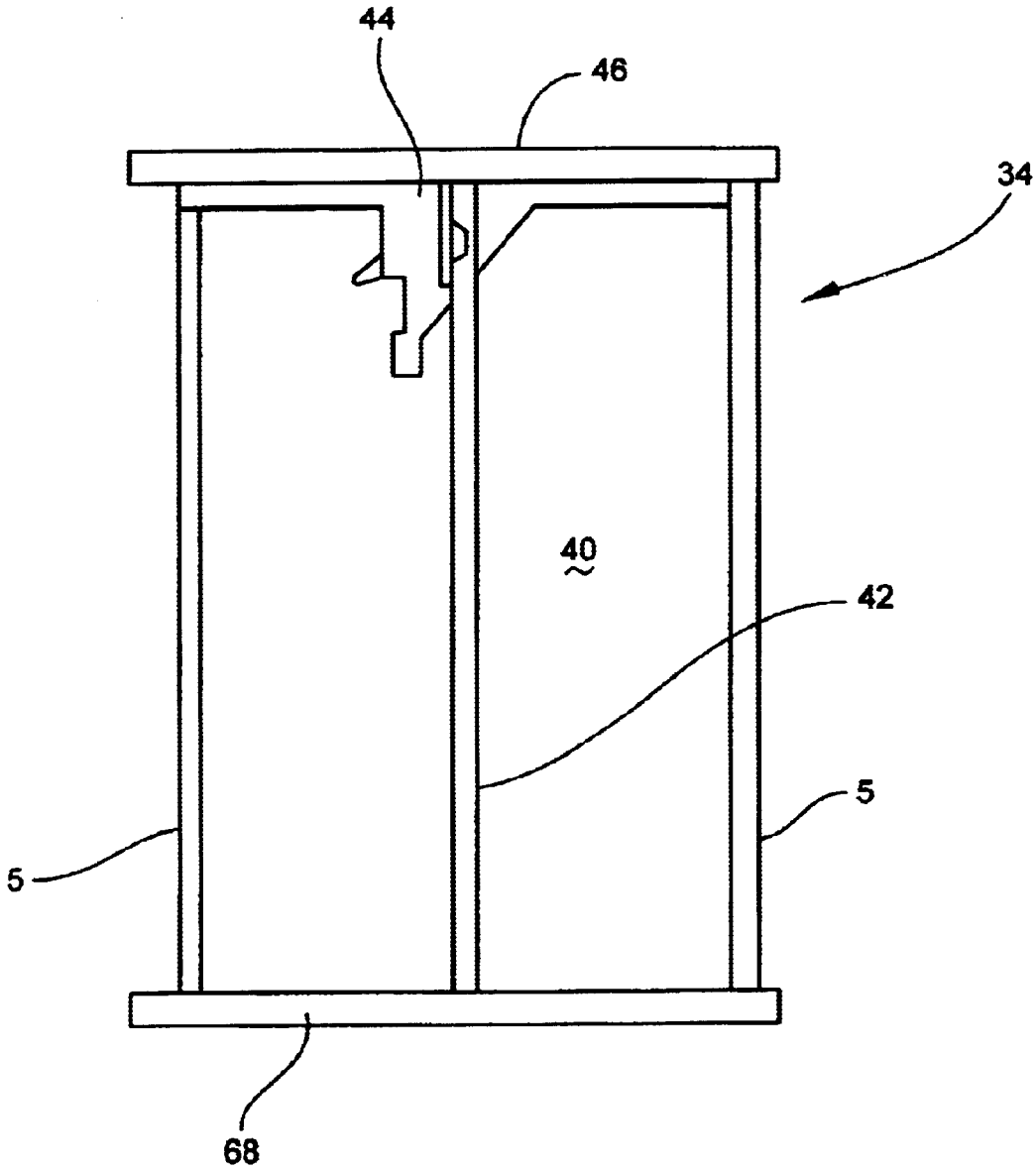
FIG. 3 is bottom plan view of a drawer suitably equipped to utilize the apparatus of the present invention shown in FIGS. 1 and 2.
Figure 4:
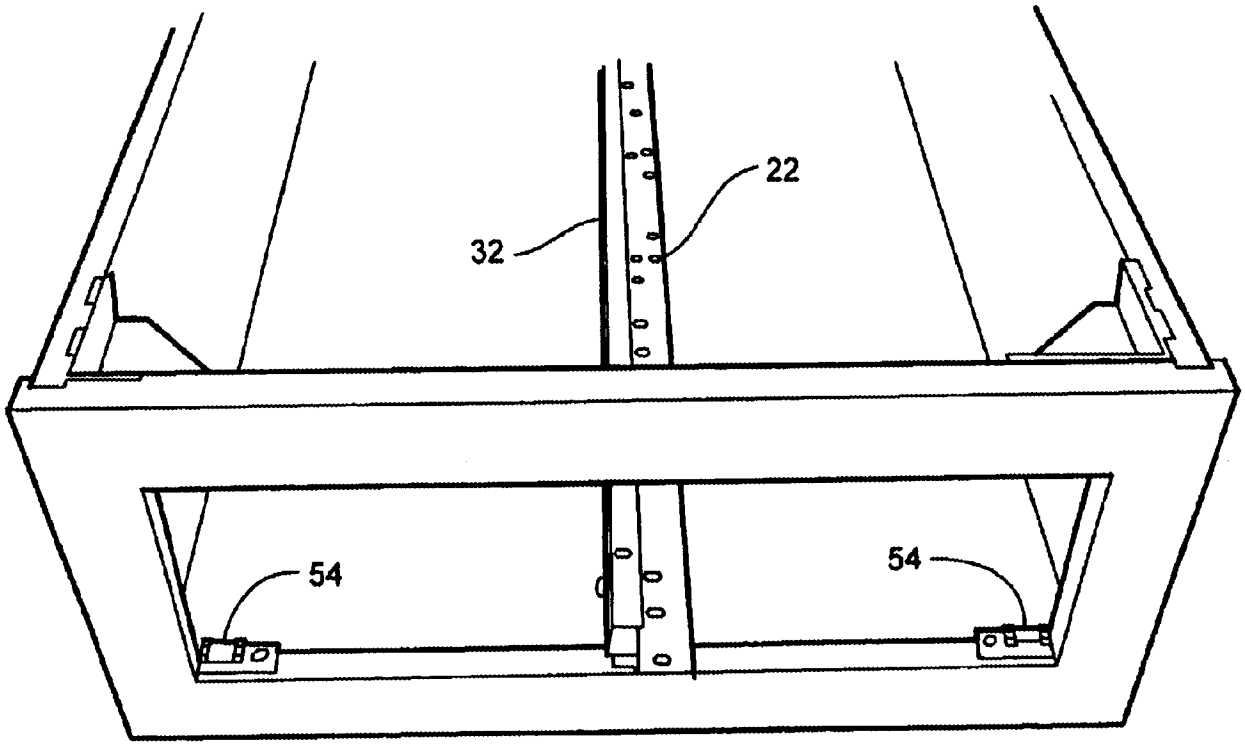
FIG. 4 is a perspective and fragmentary view of the front of the supporting frame showing the guide rail and ridge surrounding member of a single unit and the rollers functioning to stabilize the drawer when in its open or closed position.
Figure 5:
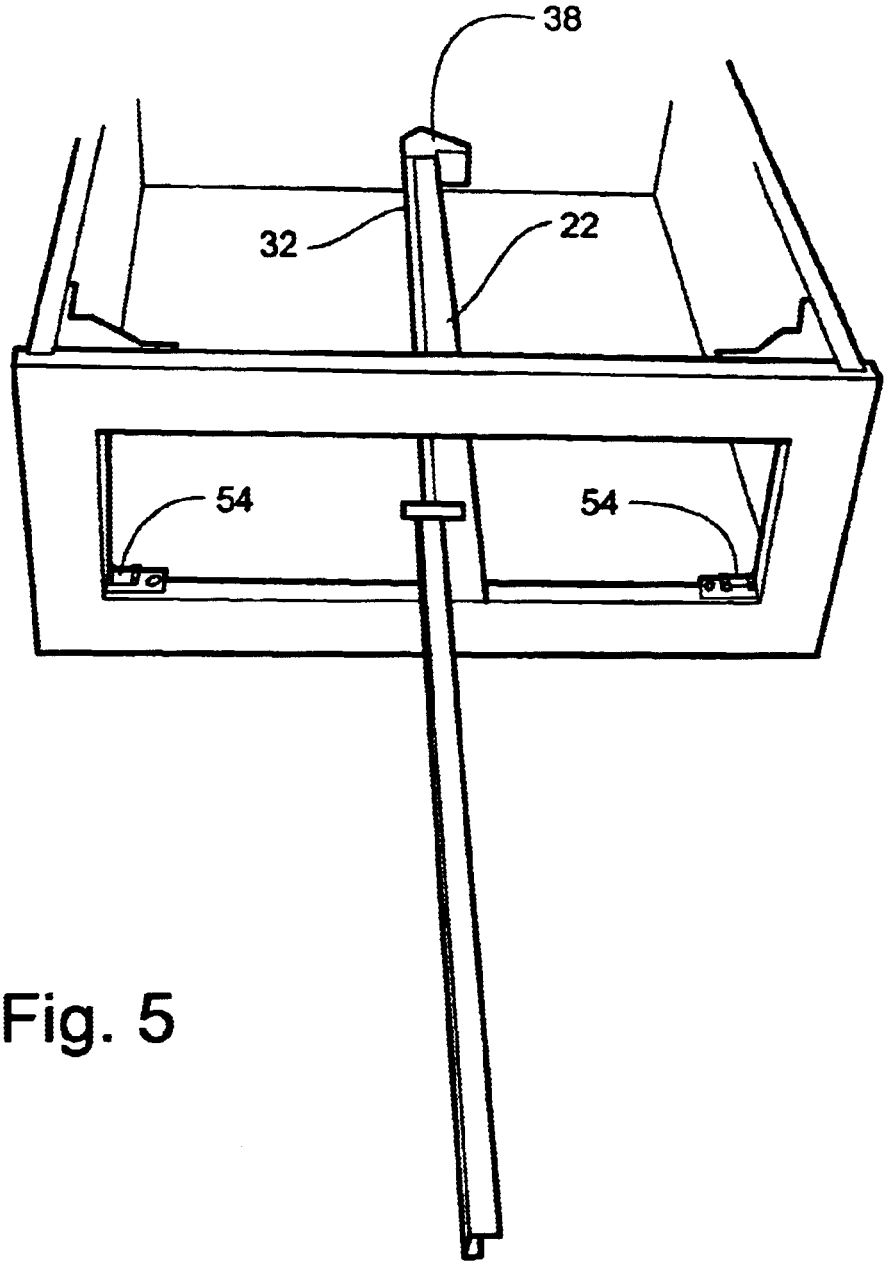
FIG. 5 is a perspective and fragmentary view of the apparatus shown in FIG. 4 and an associated drawer positioned adjacent thereto.
Figure 10:
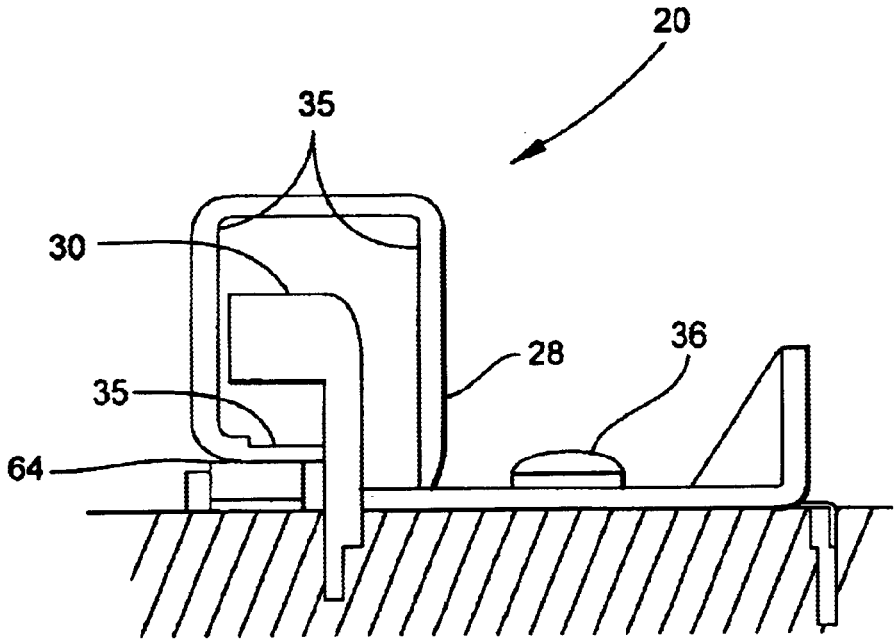
FIG. 10 is a front perspective and enlarged fragmentary view of the guide rail and its associated upstanding segment and ridge encompassed by the guide rail supporting member positioned on the frame front and guide rail supporting roller.

A ridge-surrounding member 32 cooperatively receives ridge 30 of guide rail 31 in close proximity to upstanding segment 28 and is movable with respect to guide rail 31. Ridge-surrounding member 32 is connected to the bottom or floor of an associated drawer shown generally as 34 (FIG. 3) and has four (4) linear interior walls 35 (FIG. 10).

The forward end of support member 22 is affixed to door frame front 24 by a screw 36 or some other appropriate fastening device. The trailing end of support member 22 is seated within an adjustable plastic frame rear attaching device 38 conventionally applied in drawer constructions which will allow for adjustment of member 22 to align drawer 34 within the frame particularly with respect to frame back 26.

Figure 2:
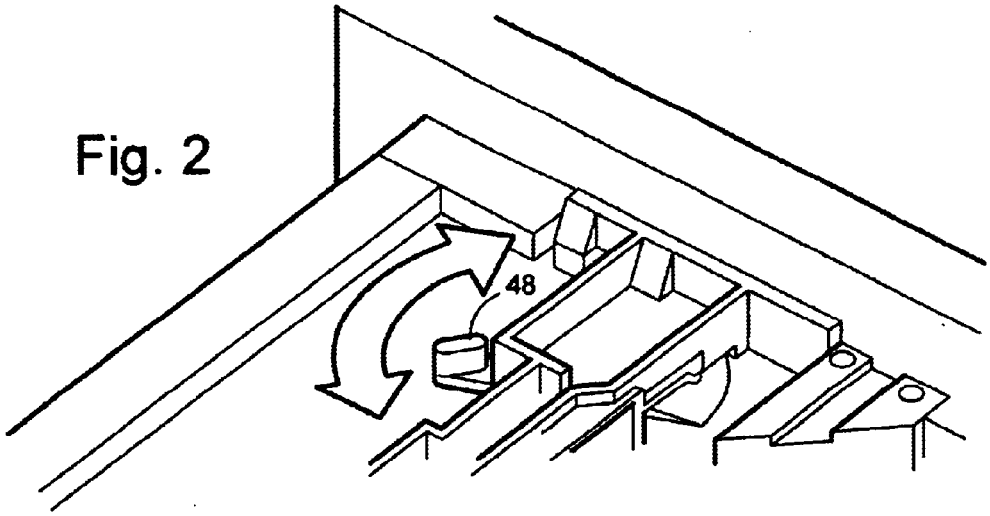
FIG. 2 is a perspective and fragmentary view of the bottom of the drawer equipped to utilize a single unit of the apparatus of the present invention.

The bottom 40 of drawer 34 has a defined longitudinal track 42 to accommodate the top of ridge-surrounding member 32. In addition to the adjustable feature provided by attaching device 38, an additional aligning device 44 is placed adjacent the drawer front 46. Aligning device 44 is centrally positioned within the width of drawer front 46 and has a height adjusting mechanism 48 (FIG. 2) which, upon movement (see arrow), can increase or decrease the elevation of the ridge surrounding member 32 (to raise or lower the elevation of the drawer) with respect to drawer front 46.

Figure 6:
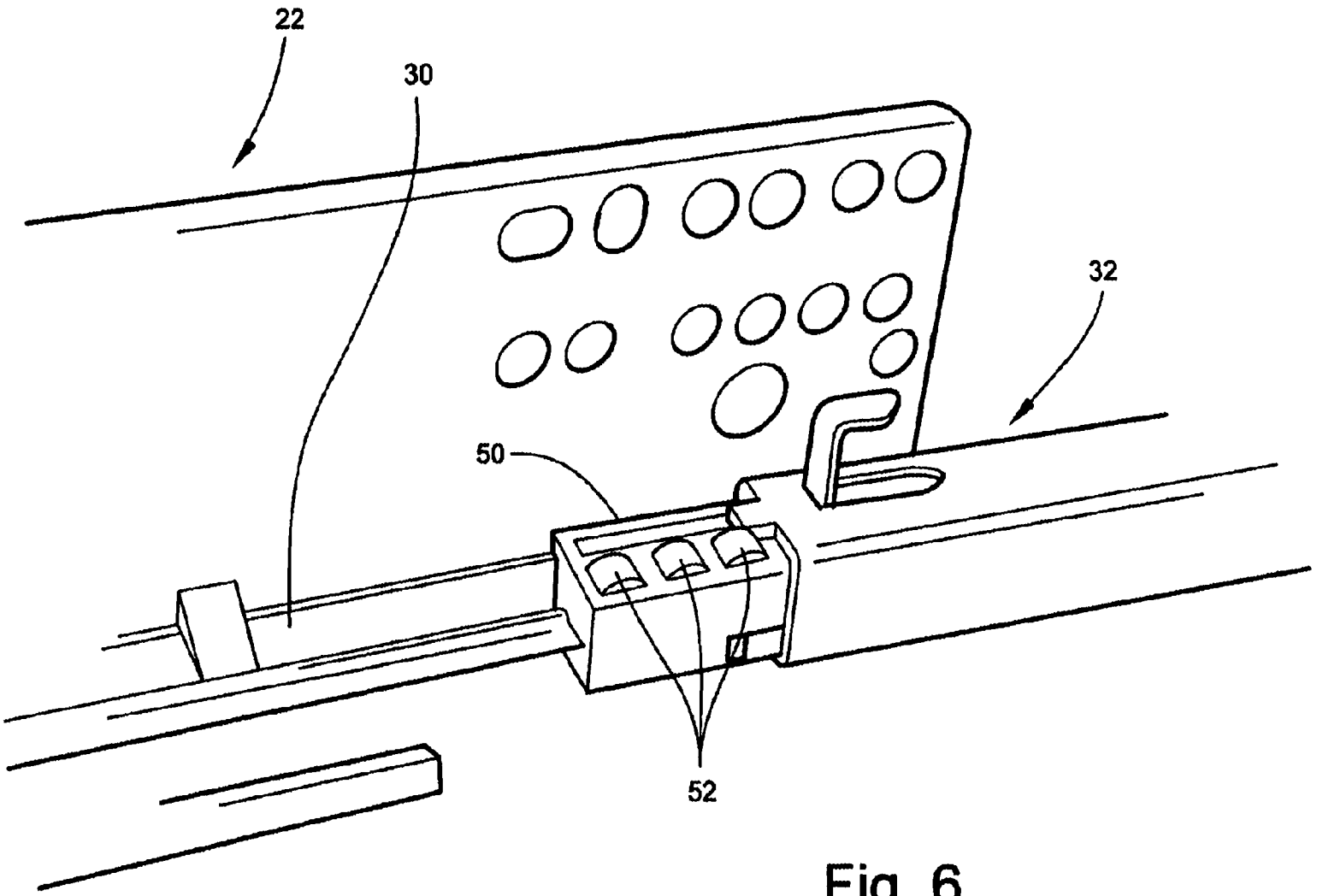
FIG. 6 is an enlarged perspective and fragmentary view of the guide rail and its associated upstanding segment and ridge encompassed by the ridge surrounding member and the movement facilitating and supporting device (often referred to the industry as a carriage) enclosed therein.
Figure 7:
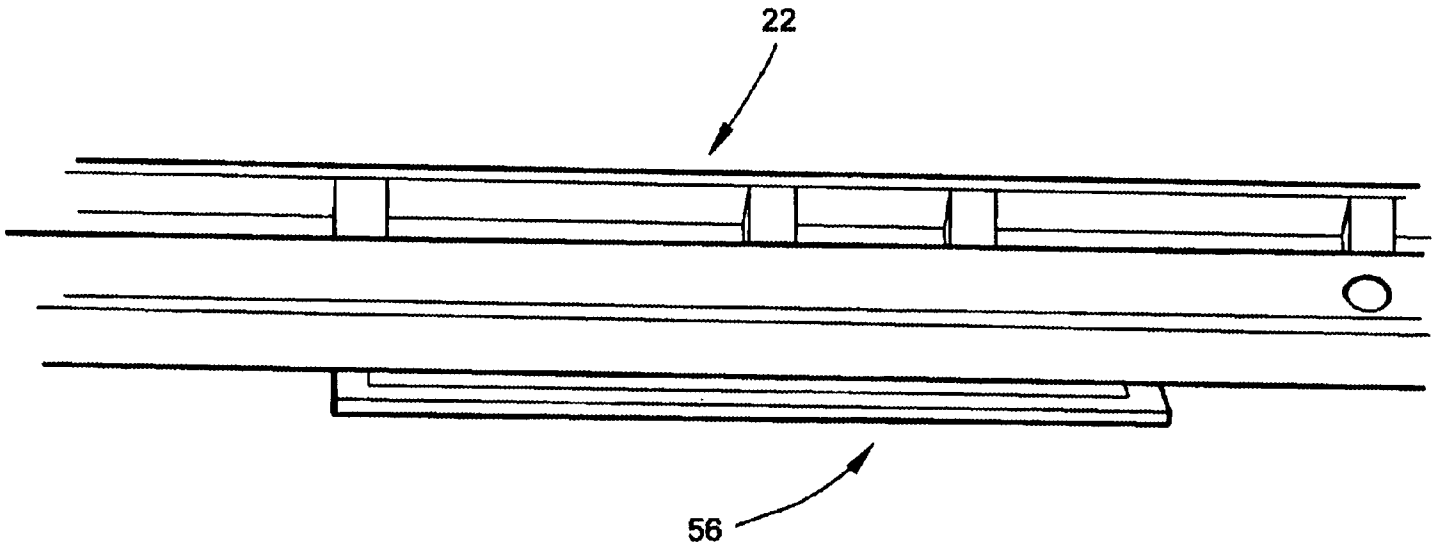
FIG. 7 is a perspective and fragmentary view of the longitudinal drawer support member and the spring mechanism affixed thereto.
Figure 8:
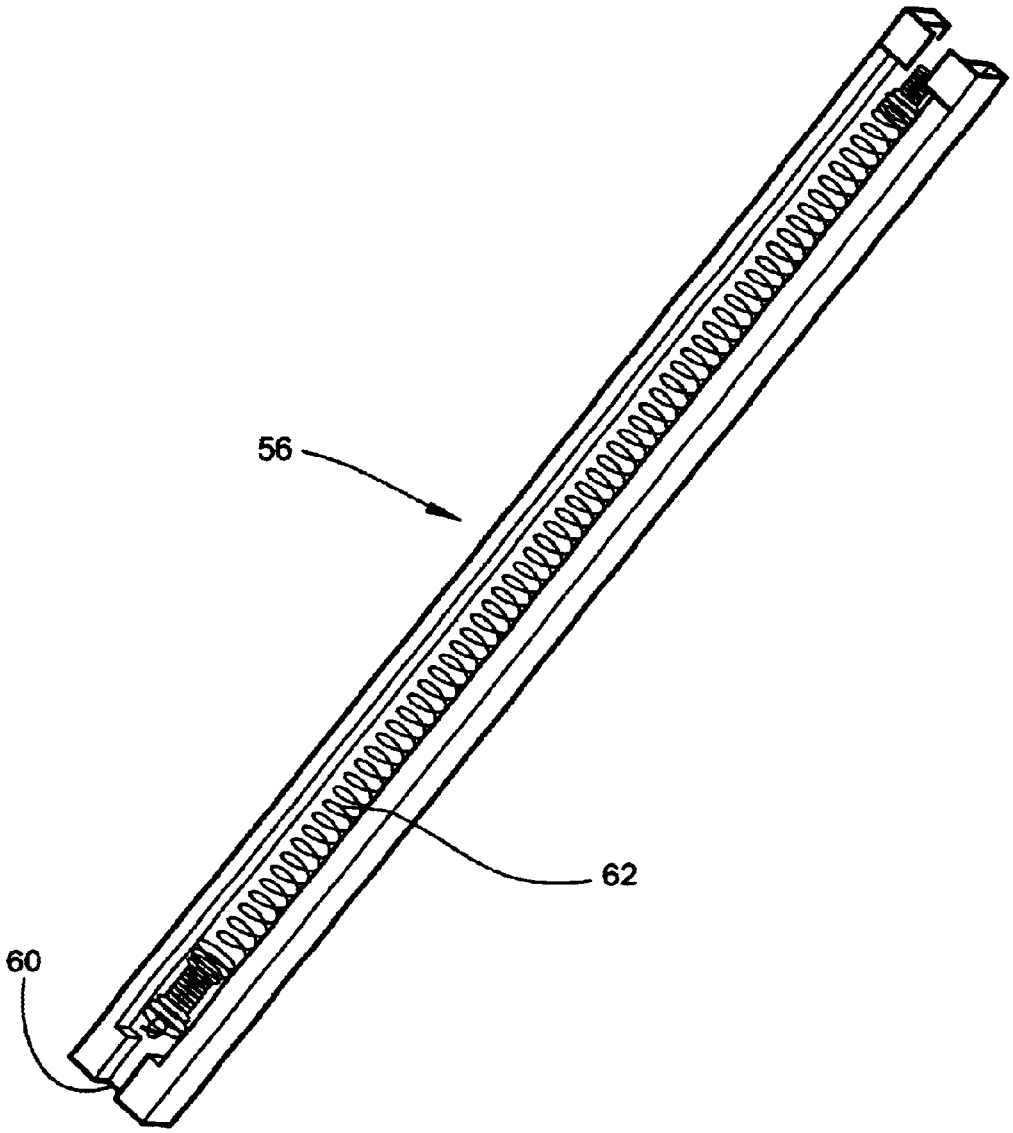
FIG. 8 is a perspective, plan view of the spring mechanism shown in FIG. 7.

A carriage shown generally as 50 is positioned within ridge-surrounding member 32 and around ridge 30 and upstanding segment 28 of guide rail 31 in a manner best shown in FIG. 6. Carriage 50 has rollers 52 in three surfaces to enhance and facilitate slidable movement between ridge 30 and ridge-surrounding member 32. The precise fit of carriage 50 within member 32 and next to ridge 30 provides continuous support for carried drawer 34 as it is extended in the open position outside frame front 24.

Rollers 54 are positioned on frame front 24 as shown in FIG. 1 to engage the lower edges of drawer sides 55 and further enhance the slidability and stability of the drawer as it is moved from the closed to the open position and back again.

A spring mechanism known in the art and shown generally as 56 is affixed to support member 22. Spring mechanism 56 has a latch/unlatch member 60 and an attached spring 62 which cooperatively function to engage a detent on ridge-surrounding member 32 as it moves to extend the drawer outwardly from frame front 24 and release the detent when the drawer is moved to the closed position to urge the drawer into the cabinet and firmly seat the drawer within the supporting frame.

A shock absorber shown generally as 74 may be cooperatively positioned with respect to spring mechanism 56 to engage the frame back 26 as shown in FIG. (16). Shock absorber 74 operates against back 26 to minimize the sound and impact when drawer 34 is firmly seated within the frame by spring 62 of spring mechanism 56. Shock absorber 74 may be of any convenient construction, and hydraulic and gas shock absorbers have been found to be particularly effective. One such absorber is shown in FIGS. (17–19) wherein a housing 76 encompasses a piston 78 within a gas or fluid medium which acts to restrict the movement of piston 78 when spring 62 urges drawer 34 to the firmly seated position. Shock absorber 74 may be positioned on either side of ridge-surrounding member 32, and is secured at pin-receiving openings 80 as shown in FIG. (16). Should more than one drawer support member 22 be used in a single drawer construction, one or more shock absorbers 74 may be used with each drawer support member 22.

Figure 9:
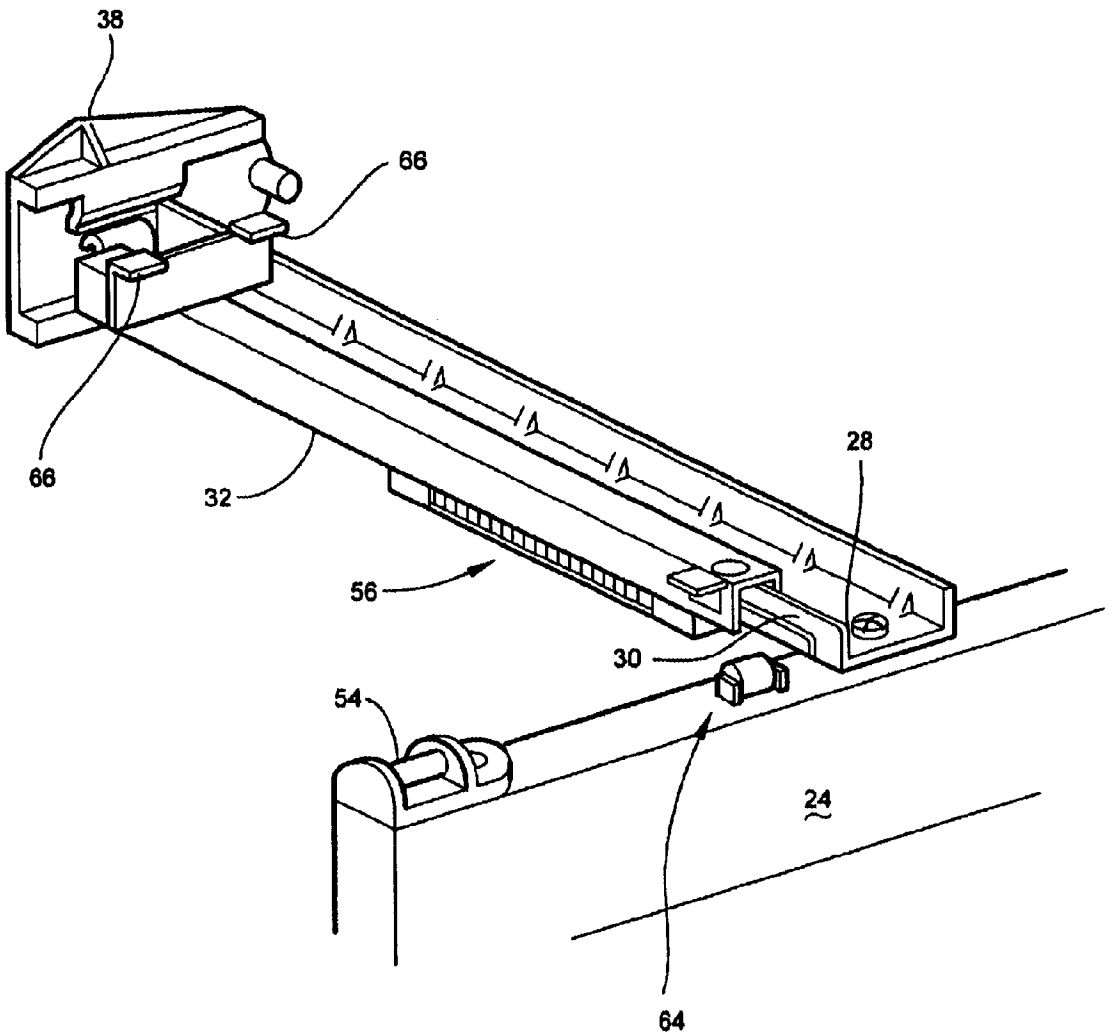
FIG. 9 is a perspective view of the guide rail connecting the supporting frame front and back and the ridge surrounding member utilizing a guide rail supporting roller.

An additional roller shown generally as 64 may be positioned along the top edge of frame front 24 as shown in FIGS. 9 and 10 to constantly engage ridge-surrounding member 32 from the drawer closed position continuously to the drawer fully opened position to provide additional stability and support for apparatus 20.

Figure 13:
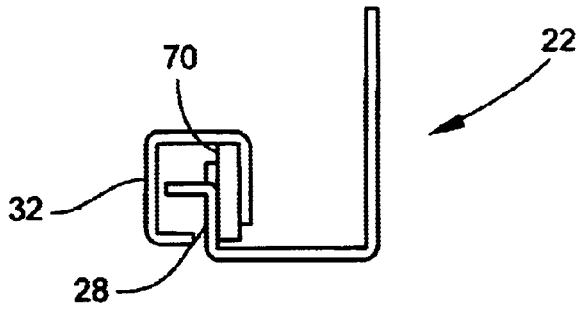
FIG. 13 is an end elevational and fragmentary view of the guide rail and its associated upstanding segment and ridge encircling member with a small load bearing roller rotatably affixed to the upstanding segment.
Figure 14:
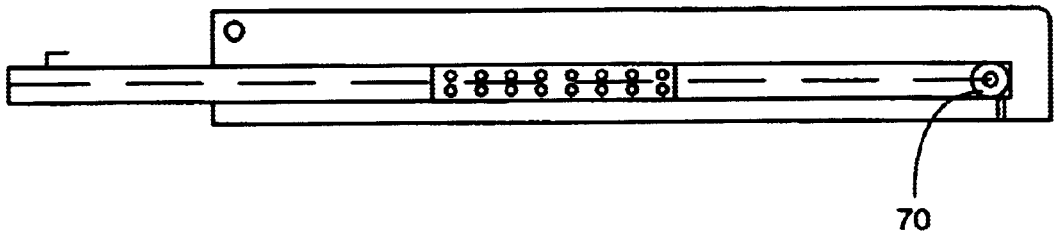
FIG. 14 is a side elevational, fragmentary view of the guide rail with a small load bearing roller secured to the upstanding segment as shown in FIG. 13.
Figure 15:
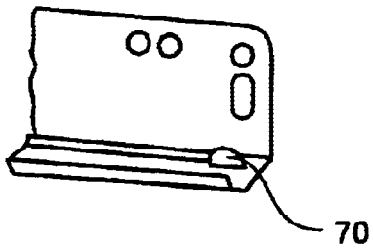
FIG. 15 is a perspective and fragmentary view of the small load bearing roller referenced in FIG. 14 which is ultimately secured to the upstanding segment shown in FIG. 13.
Figure 16:
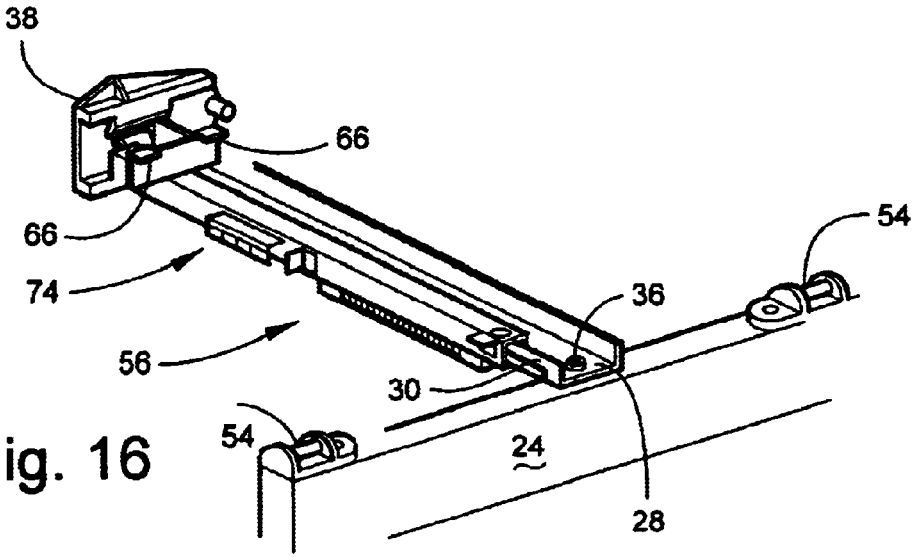
FIG. 16 is a perspective and fragmentary view of the drawer support member carrying a shock absorber which minimizes the sound and impact of the drawer being firmly seated by the spring mechanism.
Figure 17:
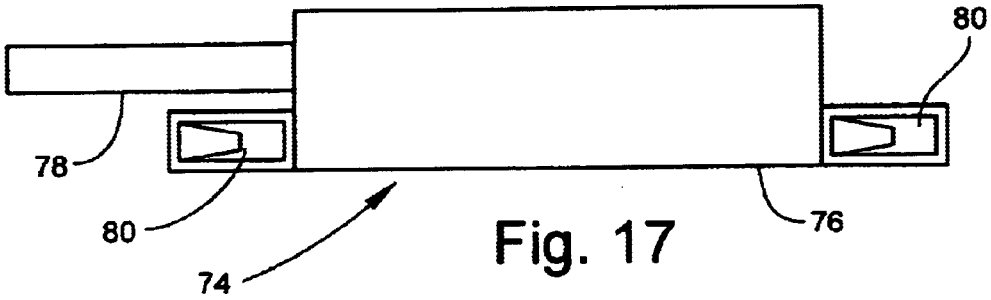
FIG. 17 is a top plan view of a shock absorber referenced in FIG. 16.
Figure 18:
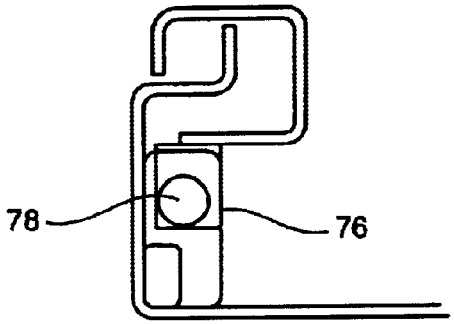
FIG. 18 is an end elevational, sectional view of the shock absorber of FIG. 17.
Figure 19:
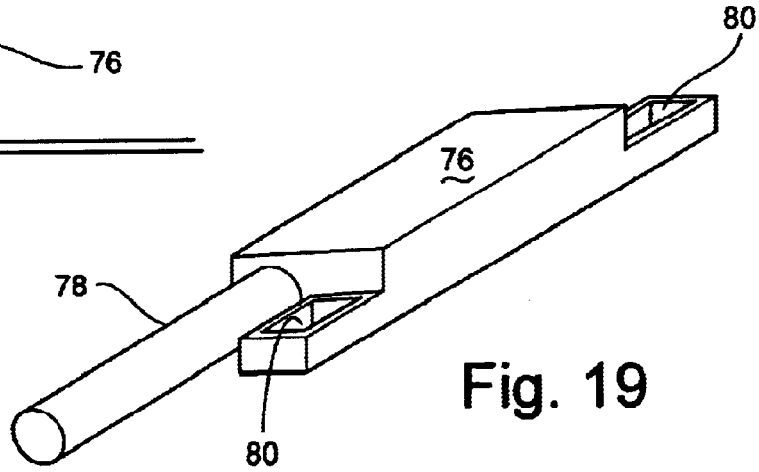
FIG. 19 is a perspective view of the shock absorber shown in FIGS. 17 and 18.

A variation of this roller device is illustrated in FIGS. 13, 14 and 15. A small load bearing roller 70 is affixed to upstanding segment 28 and engages and supports ridge surrounding member 32 from the drawer closed position continuously to the drawer fully opened position to provide additional stability and support for apparatus 20.

Drawer 34 is securely maintained within the drawer frame by its enclosure within frame front 24 and its connection with detents 66 that fit into apertures provided in drawer back 68. Removal of drawer 34 is achieved by pulling the drawer into the fully opened position and slightly lifting it so that detents 66 are removed from the apertures within door back 68.

Figure 11:
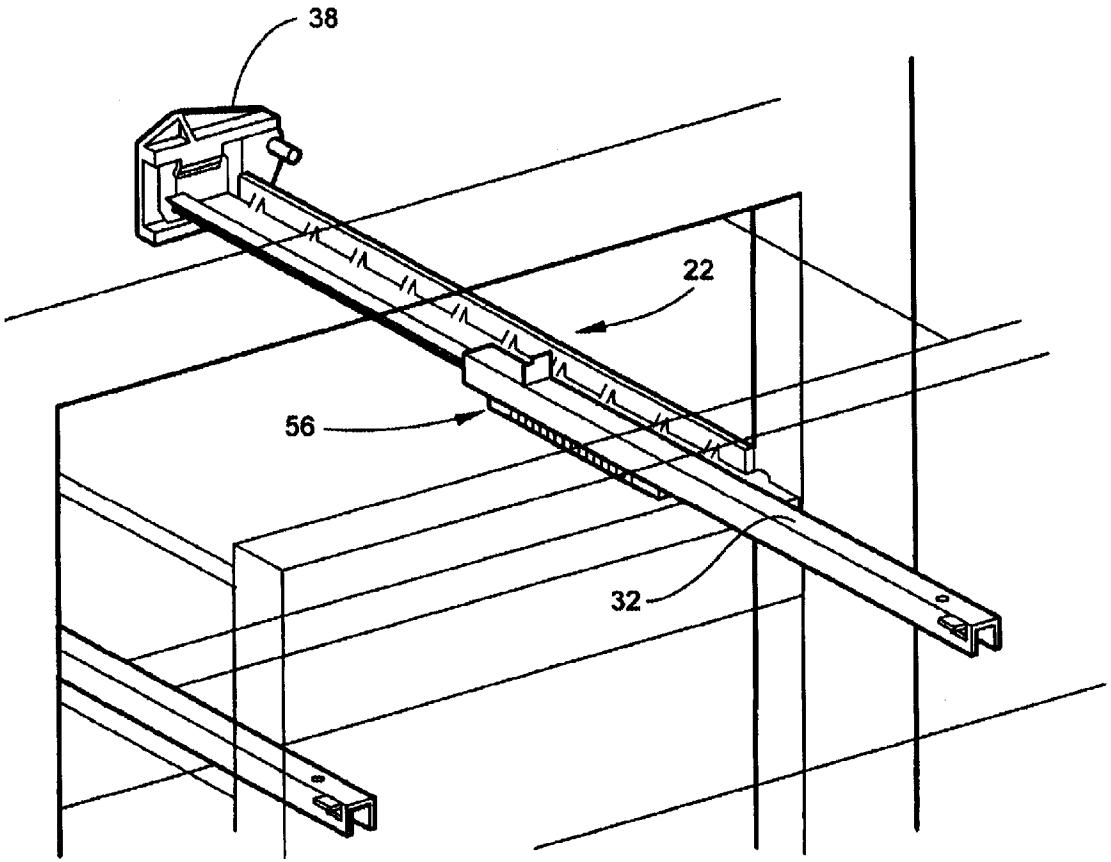
FIG. 11 is a perspective fragmentary and schematic view of an apparatus utilizing two units of the present invention both of which are connected to the supporting frame front and back.
Figure 12:
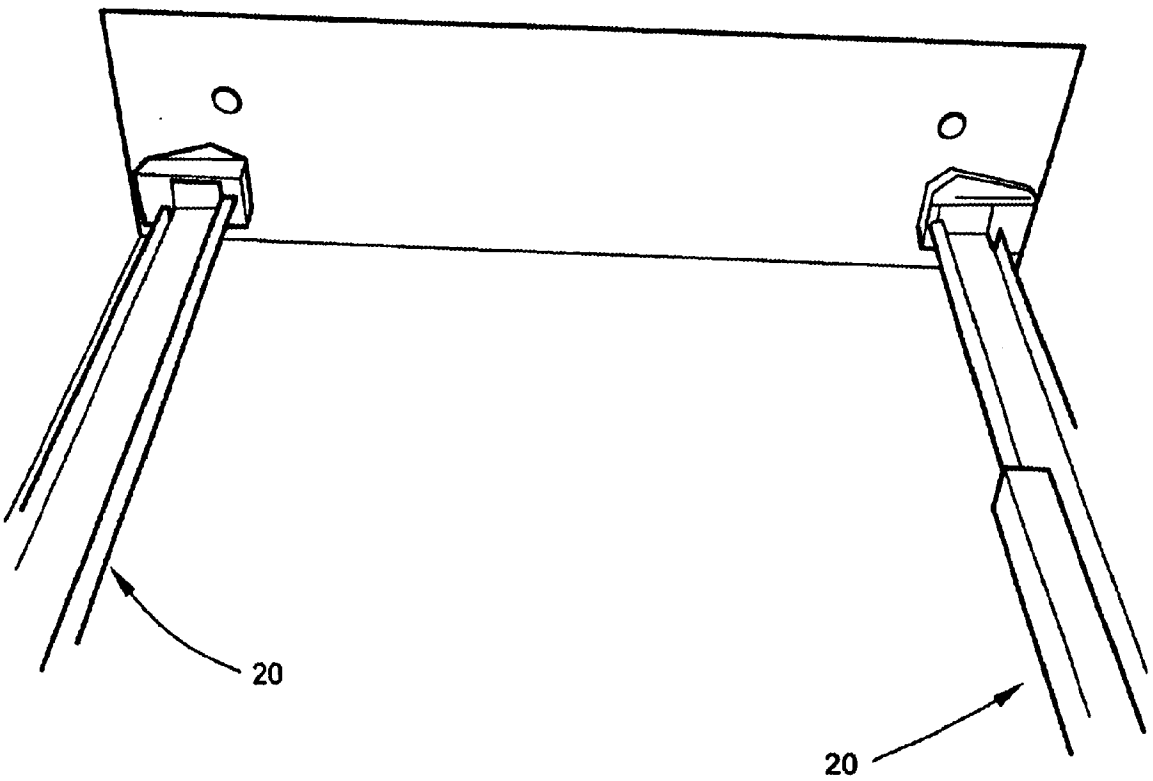
FIG. 12 is a partial perspective and interior view of a shelf interior to which are attached the guide rails of the two units shown in FIG. 11.

One unit of the invention can serve a single drawer if the drawer is small and there is no intention to carry heavy contents. That unit is positioned like the example previously described. Two (or perhaps even more) units of identical structure can be utilized on larger drawers or drawers intended to carry heavier contents as shown in FIGS. 11–12.

The drawer supporting and closing mechanism of the present invention is significantly less expensive than those described previously. Less material is needed since no profile limb for attaching the guide rail to the inside of the supporting frame is required. Other simplified features also contribute to the reduction in cost achieved by the use of the present inventive concept.

From the proceeding description, it can be seen that a drawer support and closure apparatus has been provided that will meet all of the advantages of prior art devices and offer additional advantages not heretofore achievable. With respect to the foregoing invention, the optimum dimensional relationship to the parts of the invention including variations in size, materials, shape, form, function, and manner of operation, use and assembly are deemed readily apparent to those skilled in the art, and all equivalent relationships illustrated in the drawings and described in the specification are intended to be encompassed herein.

The foregoing is considered as illustrative only of the principles of the invention. Numerous modifications and changes will readily occur to those skilled in the art, and it is not desired to limit the invention to the exact construction and operation shown and described. All suitable modifications and equivalents that fall within the scope of the appended claims are deemed within the present inventive concept.

What is claimed is:

1. Drawer support and closure apparatus for maintaining a drawer having a front, sides and back in a drawer supporting frame having a front, sides and back and providing for slidable movement by the drawer in and out of the supporting frame, the apparatus comprising: at least one drawer support member connecting the supporting frame front and back and having a flat frame-engaging portion and an integral upstanding segment with an integral horizontal flat ridge formed therewith; a ridge-surrounding member cooperatively receiving the ridge and upstanding segment and movable with respect thereto, the ridge-surrounding member having first and second side walls, a top connecting the side walls and a bottom integrally formed with one of the side walls; horizontal and vertical adjusting devices for positioning the drawer with respect to the drawer front; means facilitating non-engaging slidable movement between the ridge and upstanding segment and the ridge-surrounding member wherein the ridge-surrounding member is of substantially the same length as the length of the upstanding segment and ridge, the at least one drawer support member does not engage the supporting frame sides; and one or more small rollers engaging and acting upon the ridge-surrounding member to provide additional support and stability for the drawer with respect to the drawer frame.

2. The apparatus of claim 1 further comprising: one or more rollers engaging the drawer supporting frame sides, the one or more rollers secured to the frame and providing additional support and stability for the drawer with respect to the drawer frame.

3. The apparatus as claimed in claim 2 further comprising: spring means urging the drawer into the drawer supporting frame during drawer closure to firmly seat the drawer within the supporting frame.

4. The apparatus as claimed in claim 3 further comprising: shock absorber means engaging the frame to minimize the sound and impact when the drawer is being seated within the frame by the spring means.

5. The apparatus as claimed in claim 1 further comprising: the one or more small rollers being secured to the frame and engaging the ridge surrounding member bottom.

6. The apparatus as claimed in claim 5 further comprising: shock absorber means engaging the frame to minimize the sound and impact when the drawer is being seated within the frame by the spring means.

7. The apparatus as claimed in claim 1 further comprising: spring means urging the drawer into the drawer supporting frame during drawer closure to firmly seat the drawer within the supporting frame.

8. The apparatus as claimed in claim 7 further comprising: shock absorber means having a hawing and a piston slideably movable within the housing, the piston engaging the frame to minimize the sound and impact when the drawer is being seated within the frame by the spring means.

9. Drawer support and closure apparatus for maintaining a drawer having a front, sides and back and providing for slidable movement by the drawer in and out of the supporting frame, the apparatus comprising: at least one drawer support member connecting the supporting frame front and back and having a flat frame engaging portion and an upstanding segment with integral ridge formed therewith; a ridge-surrounding member having first and second side walls, a top connecting the side walls and a bottom integrally formed with one of the side walls, the ridge-surrounding member cooperatively receiving the ridge and integral upstanding segment and movable with resect thereto; means facilitating slidable movement between the ridge and upstanding segment and the ridge-surrounding member, wherein the ridge surrounding member bottom is adjacent the frame and is of substantially the same length as the length of the upstanding segment and ridge and the at least one drawer support member does not engage the supporting frame sides; and one or more small rollers rotatably secured to the upstanding segment and rotatably engaging the ridge-surrounding member top and the support member flat frame-engaging portion.

10. The apparatus as claimed in claim 9 further comprising: shock absorber means having a housing and a piston slideably movable within the housing, the piston engaging the frame to minimize the sound and impact when the drawer is being seated within the frame by the spring means.

11. Drawer support and closure apparatus for maintaining a drawer having a front, sides and back in a drawer supporting frame having a front, sides and back and providing for slidable movement by the drawer in and out of the supporting frame, the apparatus comprising: at least one drawer support member connecting the supporting frame front and back and having a frame-engaging portion and an upstanding segment with a ridge associated therewith; a ridge-surrounding member cooperatively receiving the ridge in close proximity to the upstanding segment and movable with respect the ridge-surrounding member having first and second side walls, and a top connecting the side walls; horizontal and vertical adjusting devices for positioning the drawer with respect to the drawer front; and means facilitating slidable movement between the ridge and upstanding segment and the ridge-surrounding member; at least two rollers secured to the frame and engaging the drawer sides; one or more small additional rollers secured to the frame bottom and engaging the ridge surrounding member and a shock absorber affixed to the ridge surrounding member and having a housing and a piston slidably movable within housing, the piston engaging the frame to minimize the sound and impact when the drawer is being seated within the frame.

12. The apparatus of claim 11 further comprising: the one or more additional small rollers being rotatably secured to the upstanding segment and rollably engaging the ridge-surrounding member top and the support member flat frame engaging portion.

* * * * *